US006567626B2

(12) United States Patent
Akaike et al.

(10) Patent No.: US 6,567,626 B2
(45) Date of Patent: May 20, 2003

(54) IMAGE FORMING APPARATUS

(75) Inventors: Akitoshi Akaike, Iwatsuki (JP); Naohisa Fujita, Iwatsuki (JP); Takashi Kurihara, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/987,415

(22) Filed: Nov. 14, 2001

(65) Prior Publication Data

US 2002/0061203 A1 May 23, 2002

(30) Foreign Application Priority Data

Nov. 20, 2000 (JP) ..... 2000-353210

(51) Int. Cl.[7] ..... G03G 21/00
(52) U.S. Cl. ..... 399/75; 399/127
(58) Field of Search ..... 399/100, 101, 399/75, 127, 128

(56) References Cited

U.S. PATENT DOCUMENTS 4,330,199 A * 5/1982 Komori et al. ..... 399/127
5,697,015 A * 12/1997 Ream et al. ..... 399/66

FOREIGN PATENT DOCUMENTS

| | | |
|---|---|---|
| JP | 3-69978 A | 3/1991 |
| JP | 8-248788 A | 9/1996 |
| JP | 11-143145 A | 5/1999 |

* cited by examiner

*Primary Examiner*—Quana M. Grainger
(74) *Attorney, Agent, or Firm*—Oliff & Berridge, PLC

(57) ABSTRACT

In an image forming apparatus for executing an image forming cycle in which a toner image is formed in response to an image formation start command and an image consisting of a fixed toner image is formed on the recording medium by transferring and fixing the toner image onto a recording medium, and executing a predetermined post-process cycle when a subsequent image formation start command is not issued within a predetermined time after a final image forming cycle is ended, there is provided a sequence controlling means for stopping the post-process cycle and causing a process to shift to a subsequent image forming cycle when the subsequent image formation start command is received during when the post-process cycle is being carried out.

4 Claims, 6 Drawing Sheets

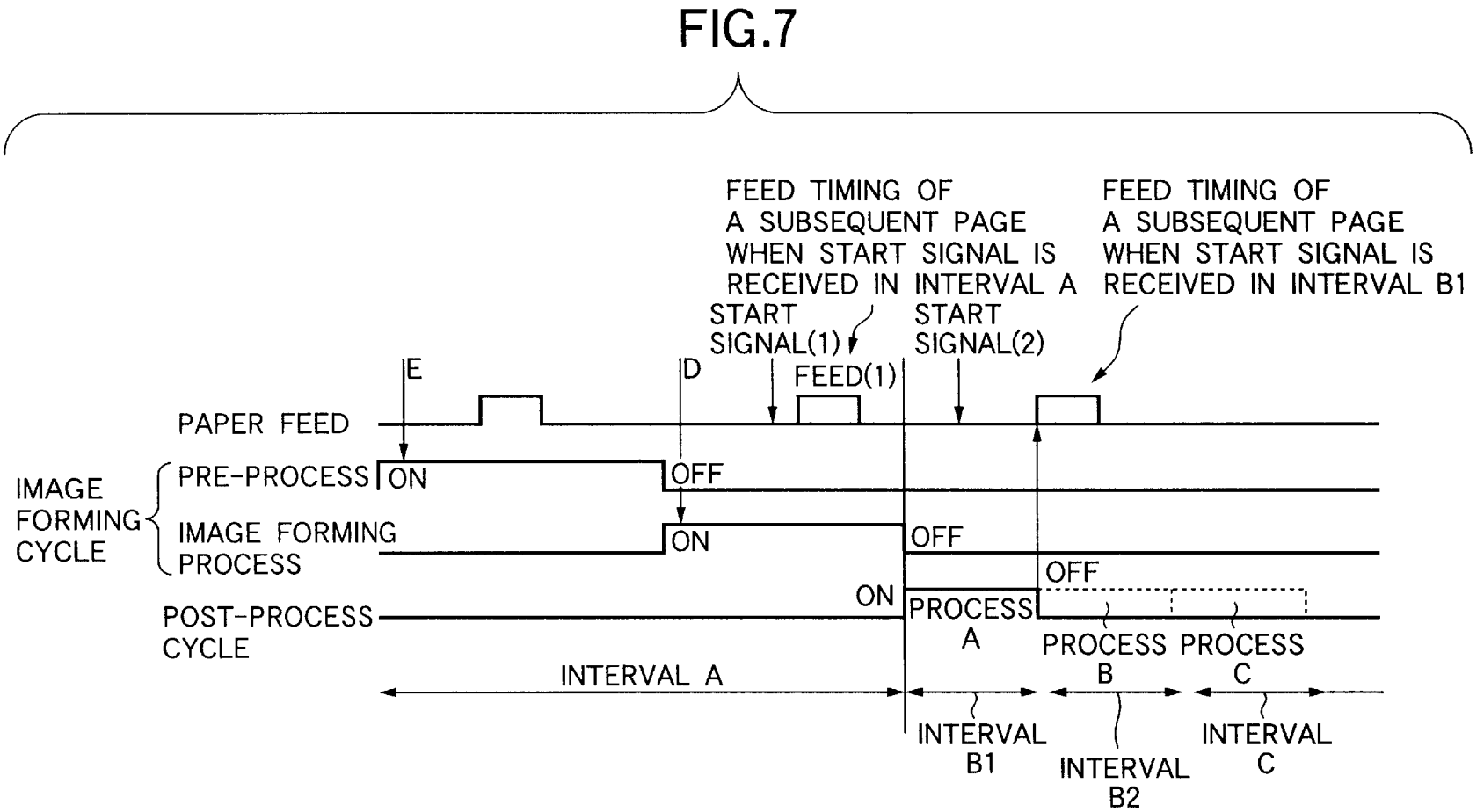
FIG.7
FEED TIMING OF A SUBSEQUENT PAGE WHEN START SIGNAL IS RECEIVED IN INTERVAL B1
FEED TIMING OF A SUBSEQUENT PAGE WHEN START SIGNAL IS RECEIVED IN INTERVAL A
START SIGNAL(2)
START SIGNAL(1)
FEED(1)
D
E
OFF
ON
OFF
ON
OFF
ON
PAPER FEED
PRE-PROCESS
IMAGE FORMING PROCESS
POST-PROCESS CYCLE
IMAGE FORMING CYCLE
INTERVAL A
PROCESS A
PROCESS B
PROCESS C
INTERVAL B1
INTERVAL B2
INTERVAL C

IMAGE FORMING APPARATUS

BACKGROUND OF THE INVENTION

1. Filed of the Invention

The present invention relates to an electro-photographic system image forming apparatus employed in the copying machine, the printer, etc. and, more particularly, an image forming apparatus using a contact transfer system.

2. Description of the Related Art

In the related art, an electro-photographic system image forming apparatus employed in a copying machine, a printer, etc. employs a non-contact type transcriber utilizing a corona discharge as a transcriber that transfers a toner image formed on an photoreceptor onto a recording medium. However, since the ozone is generated during the corona discharge in this system, the contact type transcriber that generates the less ozone is developed.

The contact type transcriber supplies transfer current to the recording medium, which is nipped between a transfer member and the photoreceptor, while applying the transfer bias to the transfer member to adsorb the toner image formed on the photoreceptor onto the recording medium side.

However, mainly a transfer roller is employed as the contact type transfer member. There is a problem that, since this transfer roller has a structure that comes into direct contact with the photoreceptor, the toner on the photoreceptor adheres to the transfer roller and thus a surface of the transfer roller is contaminated.

In order to overcome this problem, a method of cleaning mechanically the surface of the transfer roller by the blade has been proposed.

However, if a foamed sponge, or the like is employed on the transfer roller in view of the cost, the material, etc., the toner enters into pores of the roller surface and therefore sufficient cleaning is not achieved.

Consequently, cleaning technology by utilizing the static electricity is disclosed in JP-A-Hei. 3-69978, for example.

The disclosed technology is that bias between a charger and a developer is stopped after the last paper in an image forming process passes through, then a normally charged toner is reversely transferred onto a photoreceptor side by applying bias voltage having the same polarity as the toner to a transfer roller, and then a reversed toner is also reversely transferred onto the photoreceptor side by applying the bias voltage having the reverse polarity.

However, when the bias voltage having the reversed polarity is applied, the normally charged toner is transferred again onto the transfer roller and therefore it is impossible to execute the sufficient cleaning. In JP-A-Hei. 8-248788, such a technology is disclosed that the bias having the same polarity as the toner is applied to the transfer roller after the last paper in the image forming process passes through and then the bias having the opposite polarity to the toner is applied to the transfer roller before the first paper in the image forming process passes through.

However, if the bias having the opposite polarity to the toner is applied before the first paper passes through, the history is generated in the photoreceptor by the transfer bias. Therefore, the charging of the photoreceptor must be executed twice or more to erase this history, and thus it takes too much processing time.

Therefore, in JP-A-Hei. 11-143145, such a technology is disclosed that the cleaning is carried out after the transfer is completed and that the potential difference is reduced rather than that in the development, e.g., only the DC component is applied as the developing bias when the development is not executed.

According to these technologies, since the cleaning of the transfer roller is carried out after the last paper in the image forming process passes through, the time required from the start command in the last image forming cycle to the output of the image which is formed on the first recording medium (so-called FPOT: first printout time) can be reduced.

However, after the last image forming cycle is finished, in some cases the processes of detecting the current by applying the bias voltage to the transfer roller to grasp the resistance characteristic of the transfer roller with the environmental change and then correcting the bias voltage that is to be applied to the transfer roller in the subsequent image forming process, in addition to the above cleaning process of the transfer roller, are carried out in order to reduce the FPOT and assure the good transferring characteristic.

Since these processes, once started, are continued until they are completely ended, the process cannot immediately shift to the image forming process even if the image formation restart command is issued. As a result, the FPOT can be reduced, but sometimes the throughput is extremely degraded.

SUMMARY OF THE INVENTION

In view of the above circumstances, it is an object of the present invention to provide an image forming apparatus capable of reducing the FPOT and also shortening the throughput by restarting quickly the image forming process even after the image forming process is completed once.

In order to achieve the above object, an image forming apparatus according to the invention for executing an image forming cycle in which a toner image is formed in response to an image formation start command and an image formed of a fixed toner image is formed on a recording medium by transferring and fixing the toner image onto the recording medium, the image forming apparatus for executing a predetermined post-process cycle when a subsequent image formation start command is not issued within a predetermined time after the last image forming cycle is ended, the image forming apparatus comprising a sequence controlling section adapted to stop the post-process cycle when receiving the sequent image formation start command during executing the post-process cycle, to shift to execute a subsequent image forming cycle.

Here, it is preferable that the post-process cycle is a plurality of post-processes that are sequentially continued and the sequence controlling section shift-to execute the image forming cycle at a timing when the post-process, that is being executed, out of the plurality of post-processes is ended, when receiving the sequent image formation start command during executing the post-process cycle.

Here, it is preferable that the image forming apparatus further comprises a transferring member for transferring the toner image onto the recording medium and the post-process cycle includes a process of cleaning the transferring member.

Here, it is preferable that the image forming apparatus further comprises a transferring member for transferring the toner image onto the recording medium, a bias applying section adapted to apply a transfer bias voltage to the transferring member, and a current detecting section adapted to detect a transfer current that flows by applying the transfer bias voltage to the transferring member and that the post-process cycle includes a process of detecting a relationship between the transfer bias voltage and the transfer current.

Here, it is preferable that the image forming cycle includes a pre-process that is executed when the subsequent image formation start command is received after the post-process cycle is completed, and an image forming process that is executed subsequently to the pre-process and is executed when the subsequent image formation start command is issued before the image forming cycle is completed or within a predetermined time after the image forming cycle is completed and that when the subsequent image formation start command is issued during the post-process cycle is being carried out and then the post-process cycle is stopped to execute the image forming process, the sequence controlling section executes the image forming process by omitting the pre-process.

BRIEF DESCRIPTION OF THE DRAWINGS

FIG. 7 is a view showing a timing chart of the transfer roller of the present embodiment.

DETAILED DESCIRPTION OF THE PREFERRED EMBODIMENTS

Embodiments of the present invention will be explained hereinafter.

Figure 1:
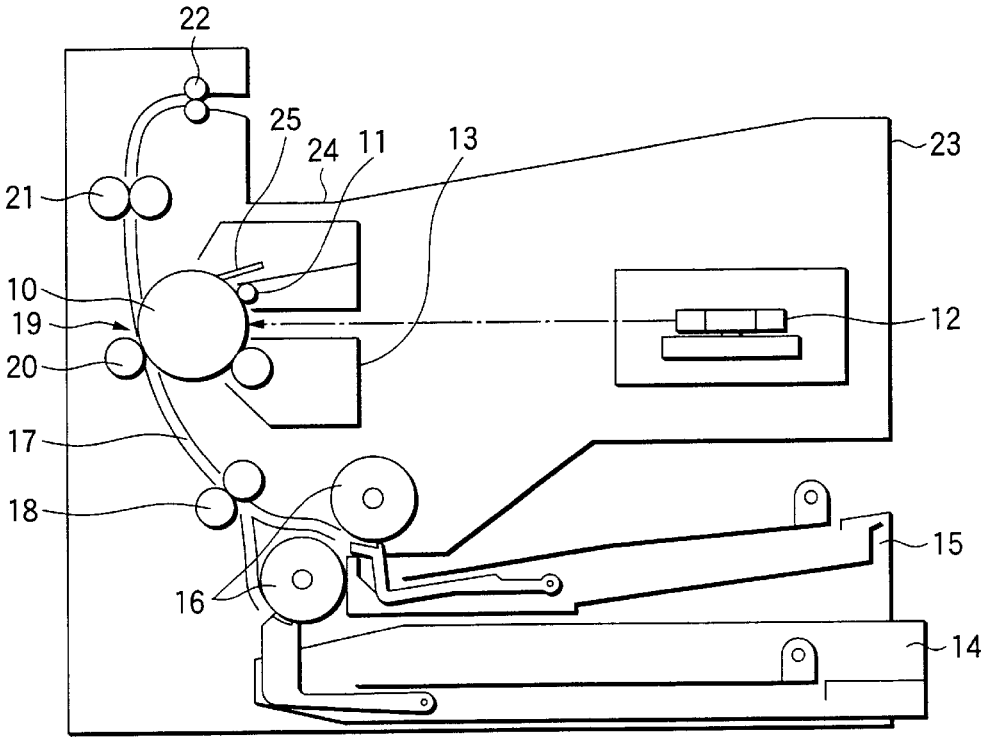
FIG. 1 is a schematic view showing a configuration of an image forming apparatus according to a first embodiment of the present invention.

FIG. 1 is a schematic view showing an outline of a configuration of an image forming apparatus according to a first embodiment of the present invention.

The image forming apparatus shown in FIG. 1 is equipped with a drum-like photoreceptor 10 for forming a toner image on a surface thereof while rotating. A charging roller 11 charges uniformly the photoreceptor 10, and then an exposing device 12 irradiates an exposure light to the uniformly charged photoreceptor 10 to form an electrostatic latent image, and then a developer 13 develops the electrostatic latent image by the toner to form a developed image. A paper feed cassette 14 and a manual paper feed portion 15 are provided to the lower portion of the image forming apparatus. A paper supplied from the paper feed cassette 14 or a postal card, an OHP film, or the like fed from the manual paper feed portion 15 is fed to a register roller 18 via a feed roller 16 through a paper carrying path 17. Based on a command issued from a timing controlling section (not shown), the register roller 18 corrects an oblique feeding of the paper, etc., adjusts a timing used to carry the paper, etc. to a transfer position 19, and decides a feed interval among a plurality of papers that are carried sequentially. The toner image formed on the photoreceptor 10 is transferred on the paper that is carried to the transfer position 19 constructed by a transfer roller 20 and the photoreceptor 10 at a predetermined timing by the register roller 18, or the like. The toner image is fixed onto the paper, or the like by a fixing roller 21. The paper on which the toner image is fixed, or the like is ejected to the outside of a housing 23 by an exit roller 22, and the ejected paper, or the like is stacked on a concave portion 24 provided at the upper portion of the housing 23. The toner remaining on the surface of the photoreceptor 10 from which the toner image is transferred is removed by a cleaning blade 25, and the photoreceptor 10 is charged uniformly by the charging roller 11 again.

Here, an outer diameter of the photoreceptor is 30 mm, an outer diameter of the transfer roller is 20 mm, and a transfer speed is 100 mm/s. Also, a feed interval between the transferred papers is controlled to 50 mm normally, and about 100 mm under a predetermined condition. The invention is not limited to these values.

Figure 2:
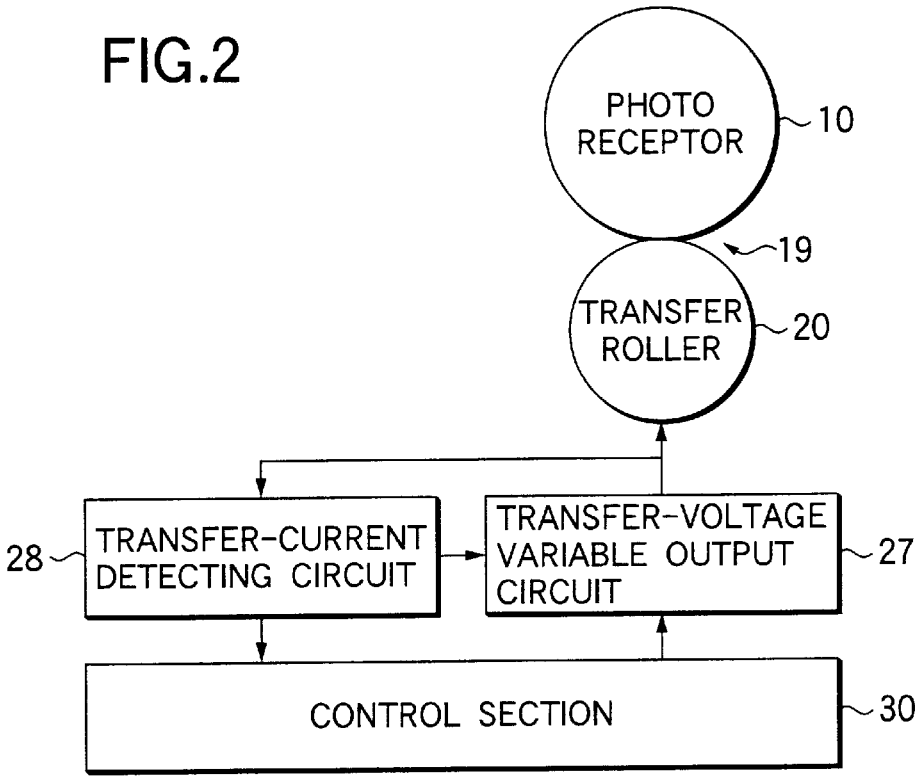
FIG. 2 is a view showing a configuration of pertinent portions for transferring a toner image at a transfer position.

FIG. 2 is a view showing a configuration of a main portion for transferring the toner image at the transfer position.

As shown in FIG. 2, the photoreceptor 10 on the surface of which the toner image is formed and the transfer roller 20 which injects the charge into the paper, or the like by applying a bias voltage are arranged such that their rotation axes are positioned in parallel with each other, both come into contact with each other to constitute the transfer position 19. A transfer-voltage variable output circuit 27 for applying the bias voltage, which is adjusted based on a transfer current flowing between the photoreceptor 10 and the transfer roller 20, to the transfer roller 20 is connected to the transfer roller 20. Also, a transfer-current detecting circuit 28 for detecting the transfer current flowing between the photoreceptor 10 and the transfer roller 20 is connected between the transfer-voltage variable output circuit 27 and the transfer roller 20. The detected result is reflected on the transfer-voltage variable output circuit 27 and a control section 30.

The control section 30 controls ON/OFF of the transfer-voltage variable output circuit 27, the voltage adjustment based on the detected result of the transfer-current detecting circuit 28, and the timing used to carry the paper to the transfer position 19. Also, the control section 30 controls a polarity inversion command that applies a reverse bias voltage, which has the same polarity as the normally charged toner, or a forward bias voltage, which has the same polarity as the reverse toner but has the opposite polarity to the normally charged toner, to the transfer roller 20 in order to execute the cleaning process of the transfer roller 20 after the image forming cycle is completed, and controls a post-process cycle for calculating the resistance characteristic by detecting transition of the transfer current by the transfer current detecting circuit 28 while adjusting the bias voltage and, as required, increasing the bias voltage of the transfer roller 20 gradually for an environment detecting process that detects a relationship between the transfer bias voltage and the transfer current.

Here, the control section 30 comprises a CPU, a ROM, and a RAM.

Figure 3:
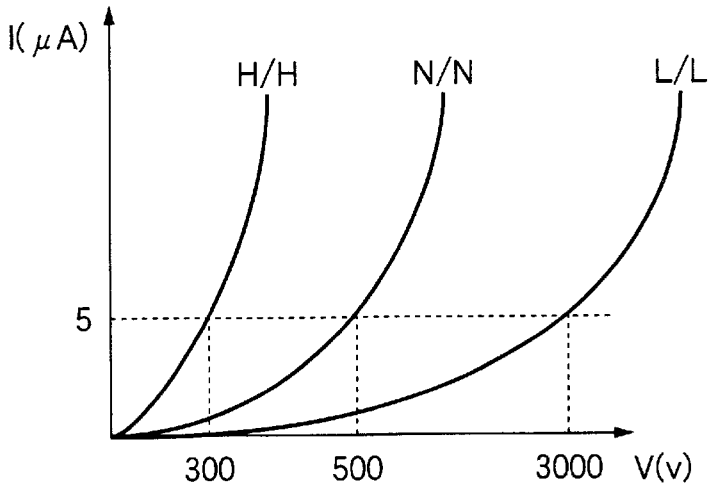
FIG. 3 is a view showing a resistance characteristic of an ionic conduction transfer roller.

FIG. 3 is a view showing the resistance characteristic of an ionic conduction transfer roller.

In the resistance characteristic shown in FIG. 3, an abscissa axis denotes a voltage V applied to the transfer roller, and an ordinate axis denotes a current I supplied to the transfer roller.

In solid lines in FIG. 3, H/H shows the characteristic of the transfer roller under a condition of high temperature/high humidity (temperature 28° C., humidity 85%), N/N shows the characteristic of the transfer roller under a condition of normal temperature/normal humidity (temperature 22° C., humidity 55%), and L/L shows the characteristic of the transfer roller under a condition of low temperature/low humidity (temperature 10° C., humidity 15%).

As the transfer roller, there is generally known a carbon dispersed transfer roller and an ionic-conductive transfer roller. The resistance value of the carbon dispersed transfer roller has the high voltage dependency in place of the small environmental dependency. However, as shown in FIG. 3, the ionic-conductive transfer roller has the low voltage dependency, but the resistance characteristic has the extremely high environmental dependency such that the resistance value is low at the high temperature/high humidity and the resistance value becomes high at the low temperature/low humidity. Accordingly, it is necessary to always grasp the resistance characteristic of the transfer roller and to set the standard bias voltage applied to the transfer roller based on the resistance value of the standard paper, which is carried to the transfer position, to be ready for the image forming command. Incidentally, the transfer roller according to the invention may be the carbon dispersed transfer roller and may be the ionic-conductive transfer roller.

Figure 4:
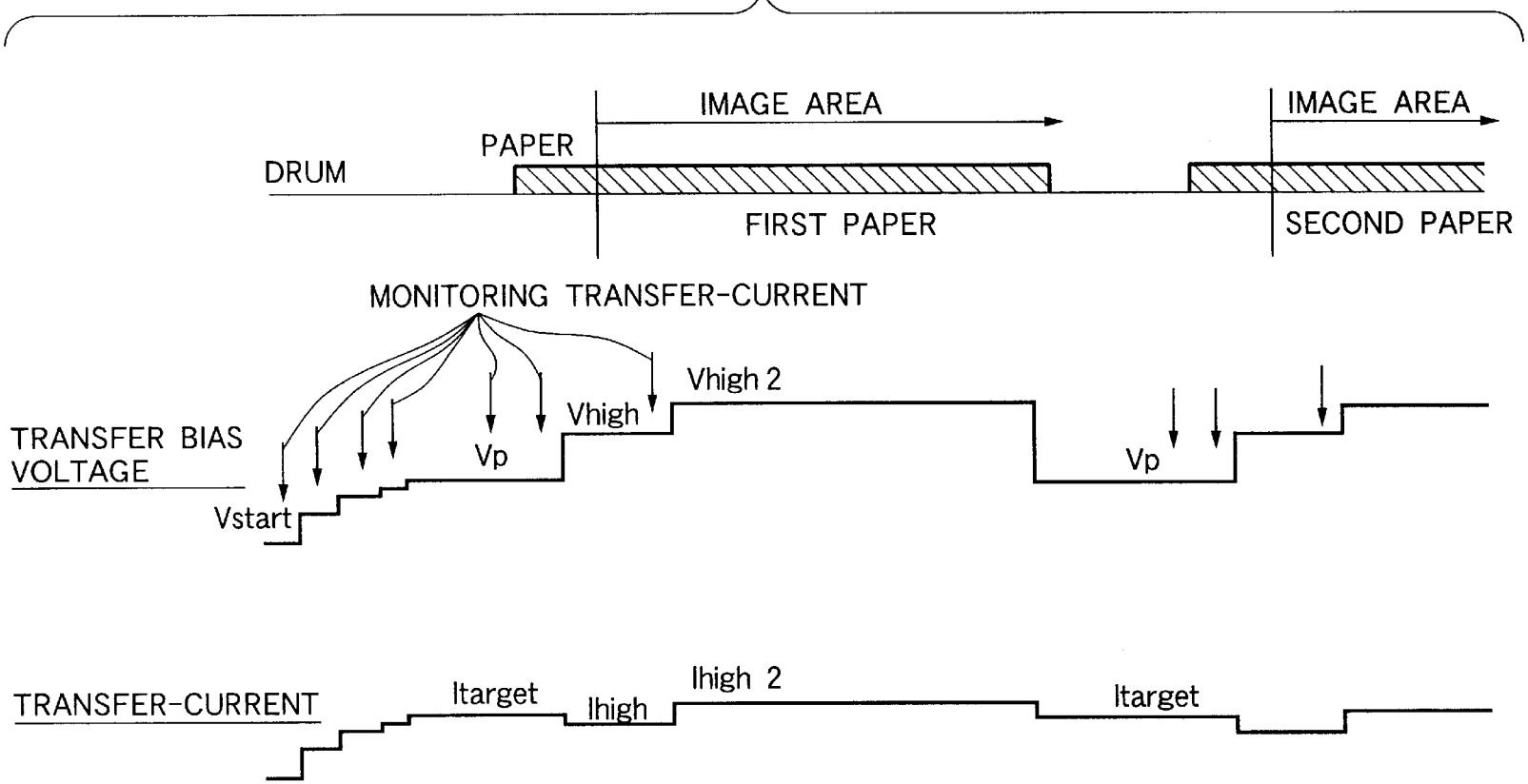
FIG. 4 is a sequence showing a control operation when a toner image is transferred sequentially onto a plurality of papers in the transfer position in which the pertinent portions are shown in FIG. 2.

FIG. 4 is a sequence showing a control operation when the toner images are transferred sequentially onto a plurality of papers at the transfer position of which the main portion is shown in FIG. 2.

The sequence shown in FIG. 4 shows the paper passing through the transfer position in an upper area thereof, shows the transfer voltage in a middle area thereof, and shows the transfer current in a lower area thereof. In this case, an abscissa axis denotes elapse of the time.

First, when the image forming cycle of the image forming apparatus is started, a pre-process is carried out. In the pre-process, the bias voltage is gradually increased from $V_{start}$ by the transfer-voltage variable output circuit 27 while monitoring the transfer current by the transfer-current detecting circuit 28 and a bias voltage Vp at a time when the transfer current reaches a target current value $I_{target}$ is maintained.

Then, the image forming process is carried out. The resistance value of an end portion of the paper is grasped based on the transfer current monitored from a time immediately before the paper comes up to the transfer position to a time until the end portion of the paper passes through the transfer position. If the resistance value of the paper is larger than a previously assumed value, a predetermined transfer current is obtained by increasing the transfer voltage to $V_{high}$. The monitoring to check the transfer current is carried out again at a stage when the paper reaches an image area. The image area is an area where an image is formed on the paper. If the transfer current $I_{high}$ does not come up to the target current value $I_{target}$ because of a high toner density, or the like, the transfer current is set to $I_{high2}$ by increasing further the transfer voltage to $V_{high2}$ to assure a required transfer current. When the paper passes through the transfer position, the transfer-voltage variable output circuit 27 lowers the bias voltage to the voltage Vp, and then maintains the bias voltage Vp until a time immediately before a subsequent paper reaches the transfer position.

Figure 5:
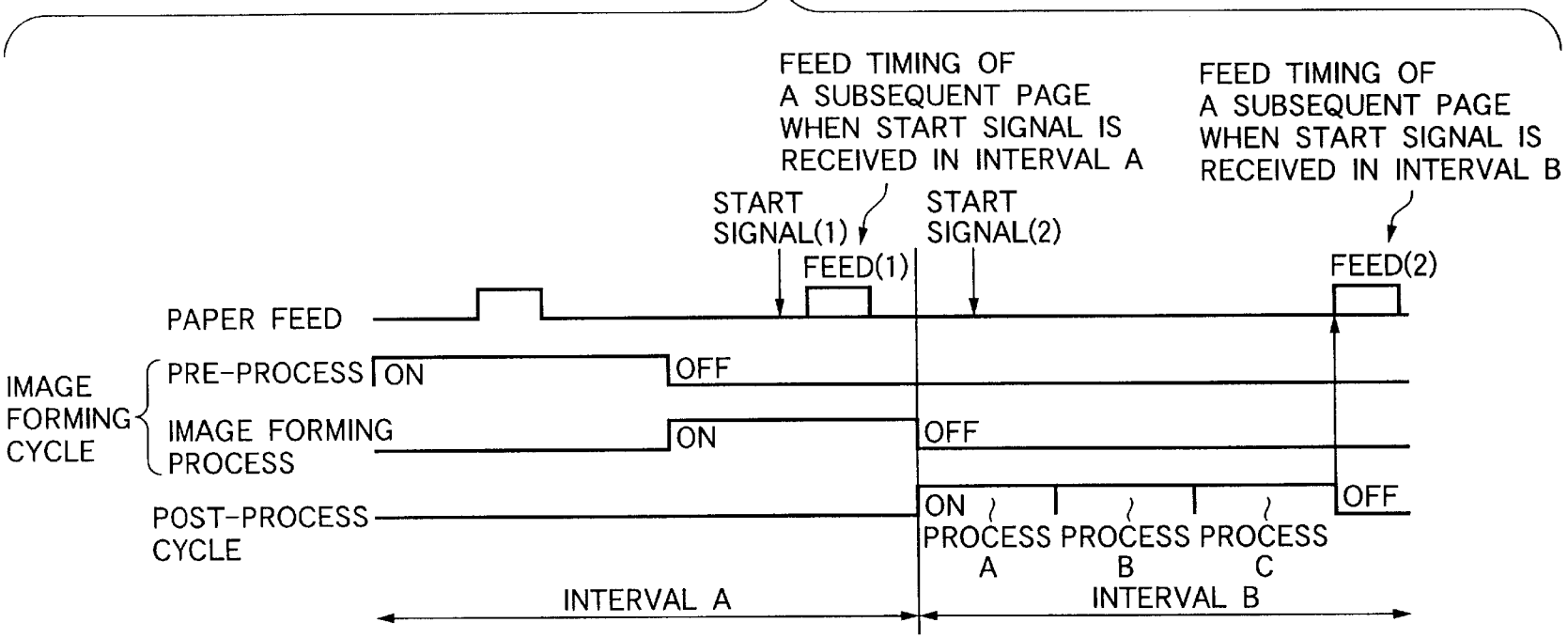
FIG. 5 is a timing chart showing an example of related art of the post-process of the transfer roller executed after the image forming process is finished, that is shown as a comparative example.

FIG. 5 is a timing chart showing a comparative example of a post-process of a transfer roller, according to a related art, executed after the image forming process is completed.

In the timing chart shown in FIG. 5, the uppermost stage shows a feed timing of a paper, the second stage shows a timing of a pre-process, the third stage shows a timing of a printing process, and the fourth stage shows a timing of the post-process. Also, the lowermost stage shows an interval A and an interval B, in which the timing is partitioned into two parts. The interval A shows the pre-process and the image forming process in the image forming cycle from an image formation start command to an end of the image formation. The interval B shows the post-process such as the cleaning of the transfer roller, the environmental detection, and the like after the end of the image formation.

In FIG. 5, when the image formation start command is issued and the image forming cycle is started, the pre-process is turned ON. Since the image forming process is turned OFF, the paper is on standby until the feed timing. When the pre-process is turned OFF and simultaneously the image forming process is turned ON after the predetermined time has lapsed, the image forming process is applied to the paper in the standby condition. In case of forming the image successively on the paper, the image forming process is applied sequentially. If the image formation start command is not issued during the predetermined time and also the subsequent paper is not fed after the last image forming cycle is ended, the image forming process is turned OFF and thus the interval A is ended.

When the interval A is ended, the post-process is turned On and the interval B is started. The post-process is divided into a post-process A, a post-process B, a post-process C, and the like.

Here, when the image formation applied sequentially in the interval A is finished and then the image formation start command is issued and a START signal (1) is received before the image forming process is turned OFF, the paper is fed immediately at a predetermined feed timing FEED (1) and the image forming process is carried out.

However, when the process goes to the interval B and the image formation start command is issued and a START signal (2) is received during the post-process being carried out, the paper is fed at a feed timing FEED (2) at which the post-process divided into the post-process A, the post-process B, the post-process C, and the like is finished completely and the post-process cycle is turned OFF.

Figure 6:
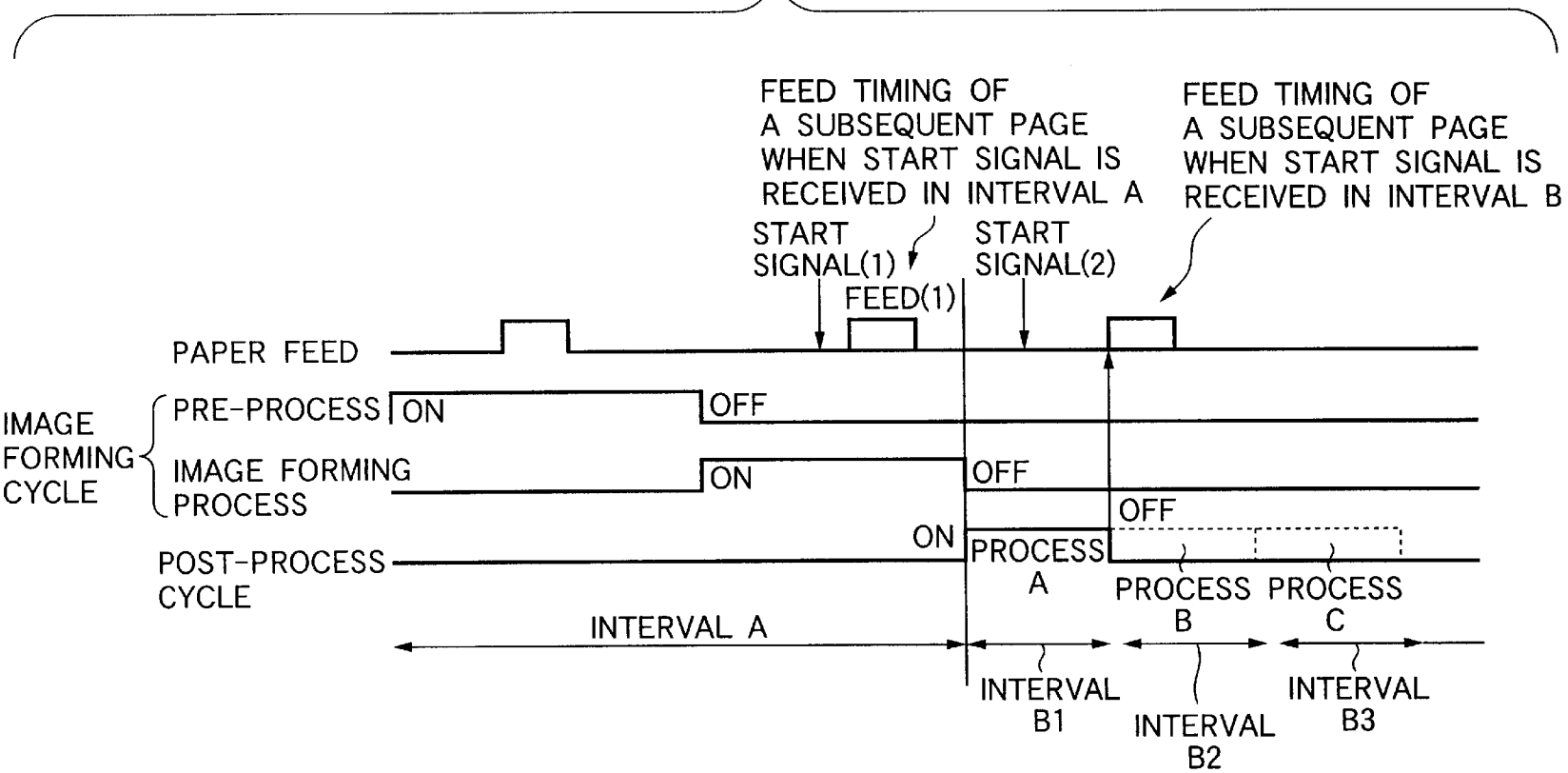
FIG. 6 is a timing chart showing the post-process of the transfer roller according to the present embodiment.

FIG. 6 is a timing chart showing a post-process of a transfer roller according to the present embodiment.

In the timing chart shown in FIG. 6, the uppermost stage shows a feed timing of a paper, the second stage shows a timing of the pre-process, the third stage shows a timing of the image forming process, and the fourth stage shows a timing of the post-process. Also, the lowermost stage shows the intervals in which timings are divided. The interval A shows the pre-process and the image forming process in the image forming cycle from an image formation start command to an end of the image formation. In the interval B, there is the post-process cycle in which the cleaning of the transfer roller, the environment detection to detect a relationship between the transfer bias voltage and the transfer current, and the like are carried out after the image formation cycle is ended.

In this case, the pre-process and the image forming process in FIG. 6 is the simplified the sequence shown in FIG. 4. The post-process is different from the timing chart shown in FIG. 5 as the comparative example.

In FIG. 6, when the image formation start command is issued and the image formation is started, the pre-process is turned ON. Since the image forming process is turned OFF, the paper is on standby. When the pre-process is turned OFF after a predetermined time has lapsed and simultaneously the image forming process is turned ON, the image forming process is applied to the paper in the standby condition. If the image should be formed successively on the paper, the image forming process is applied sequentially. If the subsequent paper is not fed within a predetermined lapsed time after the image formation is ended, the image forming process is turned OFF and thus the interval A as the image forming cycle is ended.

If the interval A is ended, the post-process is turned ON. The post-process cycle is partitioned into an interval B1 in which a cleaning process A is carried out by applying the reverse bias to the transfer roller, an interval B2 in which a cleaning process B is carried out by applying the forward bias to the transfer roller, and an interval B3 in which an environment detecting process C for detecting the relationship between the bias voltage and the transfer current of the transfer roller is carried out.

Here, if the image formation performed sequentially in the interval A is completed and then the image formation start command is issued and a START signal (1) is received before the image forming process is turned OFF, the paper is fed immediately at a predetermined feed timing FEED (1) and the image forming process is carried out.

Meanwhile, if the image formation start command is issued in the post-process cycle and the START signal (2) is received during the cleaning process A is carried out in the interval B1, the paper is fed at a feed timing FEED (2) immediately after the cleaning process A is ended. Also, if the START signal is received during the cleaning process B is carried out in the interval B2, the paper is fed at a feed timing immediately after the cleaning process B is ended, like the feed timing immediately after the cleaning process A is ended. Also, if the START signal is received during the environment detecting process C is carried out in the interval B3, similarly the paper is fed at a feed timing after the environment detecting process C is ended.

Here, the process of detecting the relationship between the bias voltage and the transfer current of the transfer roller in the environment detecting process C is carried out by applying the bias voltage to the transfer roller from the transfer-voltage variable output circuit to detect the transfer current flowing between the transfer roller and the photoreceptor by the transfer current detecting circuit. Accordingly, the resistance characteristic of the transfer roller can be obtained.

If such resistance characteristic is obtained in advance by the post-process, only the check of the resistance characteristic is requested in the pre-process and thus the FPOT can be saved.

Next, the image forming apparatus according to a second embodiment of the present invention will be explained hereinafter.

The second embodiment relates to a restart process after the post-process is stopped. A configuration of the image forming apparatus, a configuration of a main portion in the transfer position, an operation sequence of the control section, and the like are identical to those in the first embodiment, and therefore their illustration and explanation will be omitted.

FIG. 7 is a view showing a timing chart of the transfer roller according to the present embodiment.

In the timing chart shown in FIG. 7, the uppermost stage shows a feed timing of a paper, the second stage shows a timing of the pre-process, the third stage shows a timing of the image forming process, and the fourth stage shows a timing of the post-process. Also, the lowermost stage shows intervals in which the timings are divided. An interval A denotes the pre-process and the image forming process as the image forming cycle, in a period from the image formation start command to the predetermined time lapsing after the image formation is ended. The interval B1 and the interval B2 denote the cleaning process of the transfer roller and the environment detecting process to detect the relationship between the transfer bias voltage and the transfer current as the post-process cycle. Also, the interval C denotes other processes executed after the post-process cycle is completed.

The pre-process and the image forming process in FIG. 7 are the simplified the sequence shown in FIG. 4.

In FIG. 7, when the image formation start command is issued and the image formation is started, the pre-process is turned ON. Since the image forming process is turned OFF, the paper is on standby. When the pre-process is turned OFF after the predetermined time has lapsed and simultaneously the image forming process is turned ON, the image forming process is applied to the paper in the standby condition. In case of successively forming the image on the paper, the image forming process is applied sequentially. If the subsequent paper is not fed within a predetermined lapsed time after the image formation is ended, the image forming process is turned OFF and thus the interval A as the image forming cycle is ended.

If the interval A is ended, the post-process cycle is turned ON. The post-process cycle includes an interval B1 in which the cleaning process A is carried out by applying the bias voltage to the transfer roller and an interval B2 in which the environment detecting process B for detecting the relationship between the bias voltage and the transfer current of the transfer roller is carried out.

Also, there is provided herein an interval C in which other process C is carried out after the post-process cycle is completed.

Here, if the image formation executed sequentially in the interval A is completed and then the image formation start command is issued and a START signal (1) is received before the image forming process is turned OFF, the paper is fed immediately at a predetermined feed timing FEED (1) and the image forming process is carried out.

Meanwhile, after the image formation start command is issued in the post-process cycle, both the start of the image formation, which is to be executed immediately after the cleaning process A is ended if the START signal (2) is received during the cleaning process A is being carried out in the interval B1, and the start of the image formation, which is to be executed immediately after the environment detecting process B of the transfer roller is ended if the START signal is received during the environment detecting process B is being carried out in the interval B2, are processed to restart the image forming process from D shown in FIG. 7 with omitting the pre-process.

However, if after the post-process cycle is ended, the START signal is received during other process C is being carried out in the interval C, the start of the image formation that is to be executed after the process C carried out in the interval C is perfectly completed is restarted from the pre-process (that is, E shown in FIG. 7).

In this manner, when the image formation start command is issued in the middle of the cleaning process of the transfer roller or the environment detecting process in the post-process cycle, the process is restarted/processed from the image forming process located at the latter stage of the image forming cycle. Thus, the throughput becomes quick.

As described above, according to the image forming apparatus according to the present invention, the post-process of the transfer member is divided into small processes to perform the restarting process by completing the post-process every divided small process. Therefore, there can be provided the image forming apparatus in which the time (FPOT) required to output the first sheet of the paper becomes short and also the throughput required to start the image formation after the image formation start command is received is shortened.

What is claimed is:

1. An image forming apparatus for executing an image forming cycle in which a toner image is formed in response to an image formation start command and an image formed of a fixed toner image is formed on a recording medium by transferring and fixing the toner image onto the recording medium, the image forming apparatus for executing a predetermined post-process cycle when a subsequent image formation start command is not issued within a predetermined time after the last image forming cycle is ended, the image forming apparatus, comprising a sequence controlling section adapted to stop the post-process cycle when receiving the sequent image formation start command during executing the post-process cycle, to shift to execute a subsequent image forming cycle, wherein the image forming cycle includes a pre-process that is executed when the subsequent image formation start command is received after the post-process cycle is completed, and an image forming process that is executed subsequently to the pre-process and is executed when the subsequent image formation start command is issued before the image forming cycle is completed or within a predetermined time after the image forming cycle is completed, and when the subsequent image formation start command is issued during the post-process cycle is being carried out and then the post-process cycle is stopped to execute the image forming process, the sequence controlling section executes the image forming process by omitting the pre-process.

2. The image forming apparatus according to claim 1, wherein the post-process cycle is a plurality of post-processes that are sequentially continued; and the sequence controlling section shift to execute the image forming cycle at a timing when the post-process, that is being executed, out of the plurality of post-processes is ended, when receiving the sequent image formation start command during executing the post-process cycle.

3. The image forming apparatus according to claim 1, further comprising a transferring member for transferring the toner image onto the recording medium, wherein the post-process cycle includes a process of cleaning the transferring member.

4. The image forming apparatus according to claim 1, further comprising:

a transferring member for transferring the toner image onto the recording medium;

a bias applying section adapted to apply a transfer bias voltage to the transferring member; and a current detecting section adapted to detect a transfer current that flows by applying the transfer bias voltage to the transferring member;

wherein the post-process cycle includes a process of detecting a relationship between the transfer bias voltage and the transfer current.

* * * * *